United States Patent [19]

Malpas

[11] 4,325,496

[45] Apr. 20, 1982

[54] FILLING-DISPENSING CLOSURE FOR A BAG-LIKE CONTAINER

[75] Inventor: Jon H. Malpas, Ocean Grove, Australia

[73] Assignee: Diemoulders Proprietary Limited, Leopold, Australia

[21] Appl. No.: 180,310

[22] Filed: Aug. 22, 1980

[51] Int. Cl.[3] ..... B67B 7/26

[52] U.S. Cl. ..... 222/83; 128/272.3; 222/90

[58] Field of Search ..... 222/83, 83.5, 85, 86, 222/88, 89, 90, 91, 105, 107, 131, 183, 541; 150/8; 215/250, 320, 344, DIG. 1; 128/214 R, 214 D, 214 C, 214.2, 272, 272.3

[56] References Cited

U.S. PATENT DOCUMENTS

| | | | |
|---|---|---|---|
| 2,373,373 | 4/1945 | Berg | 222/91 X |
| 3,090,526 | 5/1963 | Hamilton et al. | 222/105 |
| 3,128,900 | 4/1964 | Charboche | 220/54 |
| 3,473,685 | 10/1969 | Karlan | 215/320 X |
| 3,474,933 | 10/1969 | Malpas | 222/90 |
| 3,494,496 | 2/1970 | Livingstone | 215/320 |
| 3,613,955 | 10/1971 | Wetherell, Jr. | 222/83 |
| 3,672,528 | 6/1972 | Faulstich | 215/320 X |
| 4,022,258 | 5/1977 | Steidley | 141/330 |
| 4,257,535 | 3/1981 | Mellett | 222/83 X |

FOREIGN PATENT DOCUMENTS

| | | | |
|---|---|---|---|
| 1586801 | 3/1972 | Fed. Rep. of Germany . | |
| 2657009 | 6/1978 | Fed. Rep. of Germany . | |
| 662433 | 5/1979 | U.S.S.R. | 215/320 |

*Primary Examiner*—Howard N. Goldberg
*Assistant Examiner*—Fred A. Silverberg
*Attorney, Agent, or Firm*—Tilton, Fallon, Lungmus & Chestnut

[57] ABSTRACT

A filling-dispensing closure for a bag-like container including a neck member and a closure member telescopically related thereto, the closure member having a frangible diaphragm adapted to be ruptured by a dispensing tap.

7 Claims, 8 Drawing Figures

FILLING-DISPENSING CLOSURE FOR A BAG-LIKE CONTAINER

BACKGROUND OF THE INVENTION

This invention relates to the dispensing of liquids and it refers particularly to means for use in the dispensing of liquids from flexible bag-like containers (hereinafter referred to as "bag") normally housed in a relatively rigid outer container such as a carton, can or plastics barrel (hereinafter referred to as "box"). Such composite containers are well known and are often referred to as bag-in-a-box containers. They are used particularly in the merchandising of still wines but may also be used in the merchandising of other liquids which tend to deteriorate due to the action of air or oxygen and in the merchandising of other alcoholic beverages such as saki and whisky.

Specifically, the invention relates to means by which the bag may be filled with liquid and by which the liquid may be dispensed from the bag.

It is known to provide a bag-like inner container having a filler neck through which the bag may be filled with liquid, the filler neck being then sealed off against the escape of the liquid, and a dispensing neck with a frangible diaphragm across the inner end of the neck, the dispensing neck being engageable with a socket member fitted in or to the outer container or box and said socket being adapted to receive a separate tap which, on insertion in the socket, will break the diaphragm to enable liquid to flow from the bag-like inner container to and through the tap.

It is also known to provide a bag-like inner container having a filling-and-dispensing neck to enable the bag to be filled with liquid and to which, when the bag has been filled, a dispensing tap is fitted to enable the liquid contents of the bag to be dispensed.

It is believed that in respect of this latter construction the tap may be caused to open, either inadvertently when liquid may be spilled, or deliberately for pilfering of the contents of the bag, before the sale of the bag-in-a-box container. For that reason it is believed the construction which provides a frangible diaphragm across the dispensing neck is preferable. However, with that construction it has hitherto been considered necessary to have both a filling neck and a dispensing neck at spaced locations on the bag-like inner container.

SUMMARY OF INVENTION

Accordingly it is an object of this invention to provide a bag-like inner container, for the reception and retention of liquid, having a single neck through which the bag may be filled with liquid and through which the liquid may be dispensed, and frangible diaphragm means for sealing that filling-and-dispensing neck against escape of liquid until such time as a dispensing tap has been fitted to it.

Another object is to provide a bag-like container, for the reception and retention of liquid, having a single neck through which the bag may be filled with liquid with a desired rapidity and through which the liquid may be subsequently dispensed, and means for closing the neck after the filling of the bag so as to prevent the escape of liquid through it, said closure means being adapted to receive and hold a dispensing tap in position.

A further object is to provide means for closing the opening through a filling neck of a container for liquids such that leakage or escape of liquid through the filling neck will be prevented or inhibited, the closure means being adapted to receive and hold in position a tap for dispensing the liquid contents of the container.

Yet another object is to provide a bag-like container having a filling neck, through which it may be readily filled with liquid, and a closure for that filling neck to prevent the flow of liquid from the bag through the neck, said closure being adapted to receive and hold in position a tap for the dispensing of the liquid contents of the bag and having a frangible diaphragm which will be fractured upon engagement of the tap in the closure whereby liquid will be permitted to flow from the bag through the filling neck and tap when said tap is operated.

Yet another object is to provide means for inhibiting the passage of oxygen/air to the contents of the inner container so as to increase the life of those contents should they be such that oxygen or air causes deterioration thereof.

According to one aspect of this invention there is provided a bag-like container incorporating a filling-and-dispensing neck having a passageway through which liquid may be caused to flow into the bag-like container and through which liquid may be dispensed, and a closure for the passageway through the neck, said closure having a frangible diaphragm across at least portion of the passageway through the neck adapted to prevent the flow of liquid through the closure when said closure is engaged firmly on the neck and to be fractured when a dispensing tap is engaged with the closure.

In another aspect the invention provides a closure for engagement with the outer end of a fillerneck of a bag-like container, said neck having through it a passageway to enable liquid to be fed into the bag-like container to which the neck is attached, said closure being adapted to be engaged tightly with the outer end of the neck in substantially leak-free manner and having a socket for the reception of a dispensing tap, and a frangible diaphragm across that socket whereby to prevent passage of liquid through the closure until the insertion of the tap in the socket.

In order that the invention may be readily understood and conveniently put into practical effect reference will now be made to the accompanying illustrative drawings, wherein.

DETAILED DESCRIPTION

Figure 1:
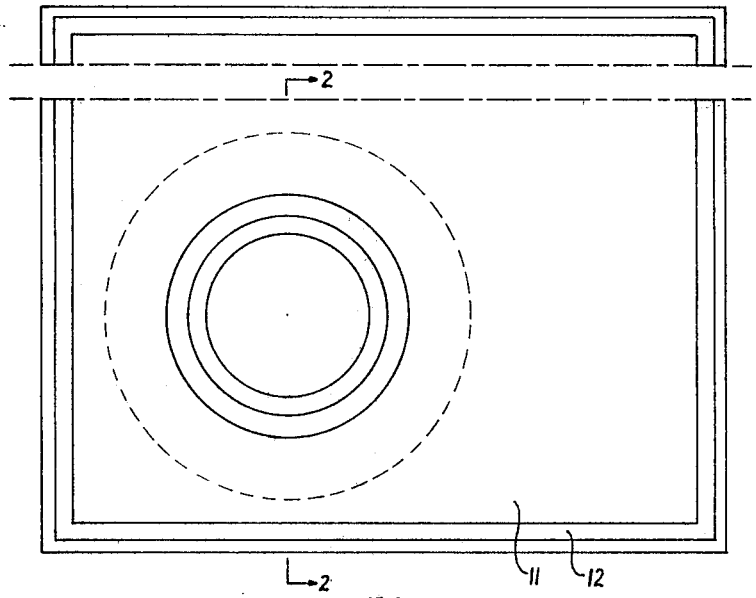
FIG. 1 depicts an inner bag-like container having near one end a neck for the reception of a nozzle of a filling machine.
Figure 2:
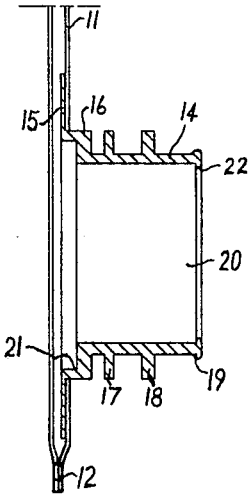
FIG. 2 is a longitudinal cross-section on the line and in the direction of the arrows 2—2 of FIG. 1, on enlarged scale.

The bag-like container 11 may be made of any suitable material, for example it may have an inner lining of polyethylene and an outer cover or lining of a metallised polypropylene or a metallised polyester, the object being to provide an inner surface material which will not react with or adversely affect the contents of the bag and a further lining which will inhibit the passage of oxygen or air through the wall of the bag to the liquid contents. The bag has two opposite walls which are sealed together around the perimeter, at 12.

Near the lower end and close to one side of the bag 11 is an opening in one side wall, and a filling neck 14 of known construction is secured to that side wall so that it extends through the opening and enables liquid to be fed into and drained from the bag. That neck 14 has a substantially cylindrical part having at its inner end a peripheral flange 15 with a shoulder 16, two spaced peripheral flanges 17 and 18 which are relatively wide in the radial direction and at the outer end an external peripheral bead or rib 19 of relatively small radial extent. A cylindrical passageway 20 extends through the neck 13 and at the inner end thereof is a peripheral recess 21. An internal peripheral bead 22 is shown at the outer end of the passageway 20.

The flanges 17 and 18 are spaced apart a distance to permit engagement in known manner, in a slot in a side wall of the outer container or box (not shown) with the material at the edges of the slot engaging between said flanges so that the neck will be held against longitudinal movement.

The closure 23 shown particularly in FIGS. 3 to 6 has an outer face 24, a substantially cylindrical skirt 25 extending from the rear surface of that face 24, a short neck 26 on the outer surface with a substantially circular flange 27 at its outer end, a part-circular flange 28 with an angled wall-part 29 on the outer surface of the flange 27, a socket 30 for the reception of the barrel of a tap substantially co-axial with the skirt 25, two spaced circumferential ribs 31, 32 within the inner surface of the skirt 25, a circular rib 33 on the rear surface of the outer face 24, a frangible diaphragm 34 across the inner end of the socket 30 and a shallow inner peripheral bead 35 at the outer end of the socket 30.

The closure 23 is made so as to be a tight fit on the outer end part of the neck 14, with the outer bead 19 engaged behind the inner circumferential rib 32 and the circular rib 33 pressing upon the internal peripheral bead 22 at the outer end of the passageway 20, with the object of preventing leakage of liquid through the passageway 20 past the closure. Further it is desirable for the inner end of the skirt 25 to press firmly on the flange 18, for the same purpose.

Both the neck 14 and the closure 23 may be made of polyethylene, to inhibit reaction between those parts and the liquid contents of the inner container.

Figure 3:
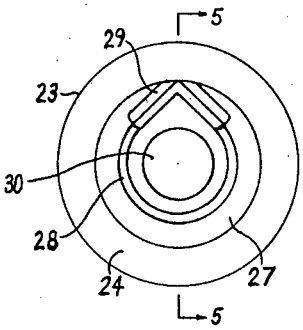
FIG. 3 is a front elevation of a closure for the filling neck, having itself a passageway for the reception of the barrel of a tap to be used for dispensing the contents of the filled bag-like container.
Figure 4:
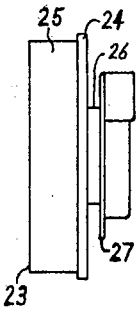
FIG. 4 is a side view of the closure depicted in FIG. 3.
Figure 5:
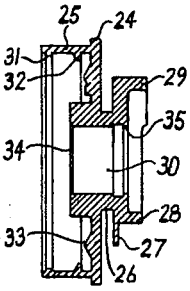
FIG. 5 shows a cross-section through the closure, on the line and in the direction of the arrows 5—5 of FIG. 3.
Figure 6:
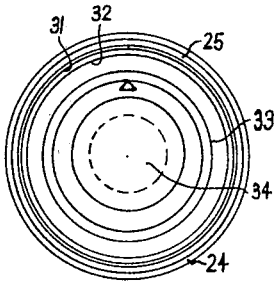
FIG. 6 is a rear elevation of the closure.
Figure 7:
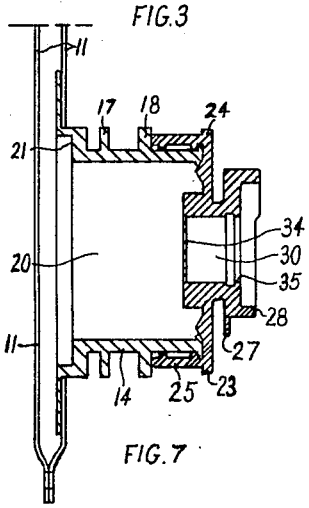
FIG. 7 shows the closure of FIGS. 3 to 6 fitted to the neck of FIGS. 1 and 2, in longitudinal cross-section.
Figure 8:
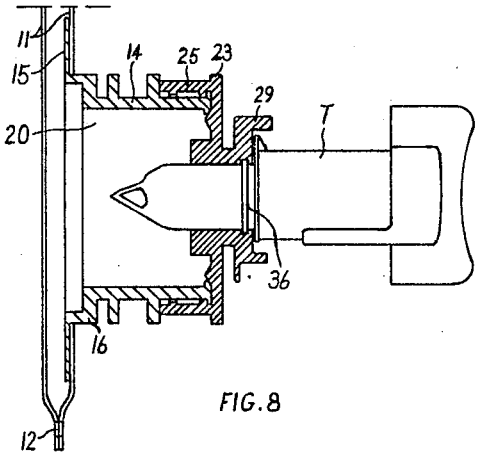
FIG. 8 is a view similar to FIG. 7 but showing a tap engaged in the passageway of the closure.

In use, the closure 23 is fitted to the end of the neck 14 after the bag 11 has been filled with liquid so as to provide a substantially leak-proof container for the liquid. The closure is so fitted to the neck that when the bag 11 is placed in its outer container or box and said box is placed in its correct upright position for dispensing its contents the angled wall part 29 on the outer side of the closure will be in the upright position as shown in FIGS. 3 and 4 so as to receive a complementary part on the outer side of a barrel of a tap T as shown in FIG. 8. That construction of tap is well known, and is made in accordance with Australian Pat. No. 407656 and known as the AIRLESFLO top.

FIG. 8 shows that tap engaged in the socket 30 with the probe at the inner end of the tap having broken and penetrated through the frangible diaphragm 34 of the closure and the shallow peripheral rib 35 engaged behind a shallow peripheral rib 36 on the outer surface of the barrel of the tap.

It is to be realised that the closure 23 may be made to receive a tap other than the AIRLESFLO tap referred to and shown in FIG. 8 of the drawings. Also, the closure may be made to engage tightly on the outer end of neck parts of different design from that illustrated in the drawings. Thus, merely by way of example, the peripheral flange 18 may be eliminated and the overall length of the neck reduced accordingly as the inner end of the closure 23 may be made to serve the same purpose as that flange 18 in engaging the material of the box so as to hold the neck part in position in the box.

In a modification of the filling neck 14 the external flange 18 is eliminated and the neck is made shorter by the thickness of that flange. When the closure is fitted on the neck 14 the inner end of the skirt 25 functions in the same manner as the flange 18 of the construction illustrated in the drawings.

In the constructions described above there may be provided an additional barrier to inhibit the flow of oxygen to the contents of the bag-like container. This may be done by welding a film of a suitable material, such as polyethylene-coated metallised polypropylene or polyethylene-coated metallised polyester, across the opening at the inner end of the passageway 20 after the bag has been filled with wine or other liquid. Such material may be accommodated in the peripheral recess 21. Alternatively, a film of such material may be secured across the outer end of the socket 30 to restrict the flow of oxygen through the plastics material of which the closure is made.

It will be understood that various modifications in detail of design and construction may be made without departing from the ambit of the invention as defined by the appended claims.

What I claim is:

1. A filling-dispensing neck member (14) and closure member (23) combination for a bag-like container (11), said neck member (14) having a passageway (20) through which liquid may be caused to flow into the bag-like container (11) and through which liquid may be dispensed, said closure member (23) having a socket (30) for the reception of a barrel of a dispensing tap (T), an oxygen impermeable diaphragm (34) across said socket (30), means (35) in said socket (30) for restraining the barrel of the tap (T) against longitudinal movement once the tap (T) is engaged in it and has broken the diaphragm (34), said closure member (23) having a circumferential skirt (25) adapted to fit over and engage with the outer end of the neck member (14) and said skirt (25) having at least one internal circumferential rib (32) for locking engagement with an external complementary bead (19) on the outer end part of the neck member (14).

2. A neck member and closure member as claimed in claim 1, characterized by means (29) for engagement by the tap (T) adapted to hold said tap (T) against rotary movement.

3. A neck member and closure member as claimed in claim 1 or 2, characterized by said closure member (23) having an end wall (24) for engagement with the outer end of the neck member (14) and on the inner surface of the end wall (24) is a circular rib (33) adapted to engage with an internal bead (22) at the outer end of the neck member (14).

4. A filling-dispensing closure for a box-supported bag-like container comprising a unitary, generally tubular resilient plastic neck member having an inner end and an outer end and a through passage extending from one end to the other, said inner end being equipped with an outwardly radially extending integral flange for mounting within said container, said outer end being equipped with an integral radially outwardly extending bead, a unitary generally tubular resilient plastic closure member having an inner end and an outer end and a through passage extending from one end to the other, said closure member being disposed in telescopic relation relative to said neck member with said closure member outer end being disposed outwardly of the outer end of said neck member and the inner end of said closure member being positioned in said neck member through passage and with said passages being coaxial, an oxygen impermeable diaphragm mounted across said closure member inner end and closing the through passage of said closure member, said closure member having an integral face-providing wall portion extending radially away therefrom intermediate the ends thereof for bearing engagement of the face thereof with the outer end of said neck member, said wall portion being equipped with an axially extending skirt on the periphery thereof extending toward said neck member inner end and being disposed radially outwardly of said neck member, said skirt being equipped with an internal annular rib spaced from said wall to resiliently clamp said neck member bead between said rib and wall, said closure member in the through passage thereof being equipped with annular groove means for retaining the barrel of a tap against longitudinal movement after the tap has ruptured said diaphragm by inward sliding movement within said closure member through passage, and further engaging means on said members spaced from said head and rib to provide a second liquid seal.

5. The structure of claim 4 in which said further engaging means includes radially inwardly extending bead on said neck member and an inwardly projecting rib on the inner surface of said face-providing wall portion.

6. The structure of claim 4 in which said further engaging means includes an integral radially outwardly extending flange on said neck member positioned intermediate the ends thereof for coaction with the inner end of said skirt.

7. The structure of claim 4 in which said closure member outer end is equipped with integral means for maintaining said tap against rotary movement.

* * * * *